United States Patent [19]

Gutjahr

[11] 4,000,560

[45] Jan. 4, 1977

[54] ELECTRIC SHAVER

[76] Inventor: Gert Gutjahr, Neckarhauserstrasse 61, 6800 Mannheim, New Edingen, Germany

[22] Filed: Feb. 19, 1976

[21] Appl. No.: 659,468

[30] Foreign Application Priority Data

Apr. 24, 1975 Germany ..... 2518140

[52] U.S. Cl. ..... 30/41.6

[51] Int. Cl.[2] ..... B26B 19/38

[58] Field of Search ..... 30/41, 41.5, 41.6, 133

[56] References Cited

UNITED STATES PATENTS

| | | | |
|---|---|---|---|
| 2,129,559 | 9/1938 | Blackwell | 30/41.5 |
| 2,720,696 | 10/1955 | Wadsworth | 30/41.5 |
| 3,027,635 | 4/1962 | Frith | 30/41.6 |
| 3,828,430 | 8/1974 | Yamada | 30/41.5 |

*Primary Examiner*—Gary L. Smith
*Attorney, Agent, or Firm*—Hans Berman

[57] ABSTRACT

The cavity in the head of an electric shaver which is bounded by the shaver body and a perforated metal foil or guard encloses a blade assembly in shearing engagement with the guard and oscillated by an electric drive mechanism in the body. A partition fixedly attached to the blade assembly separates a first compartment of the head cavity near the shearing area from a second compartment remote from the perforations in the guard. Apertures in the partition taper from the first toward the second compartment so that hair clippings driven through the apertures by the oscillating partition cannot return to the shearing area.

6 Claims, 2 Drawing Figures

Figures 1, 2:
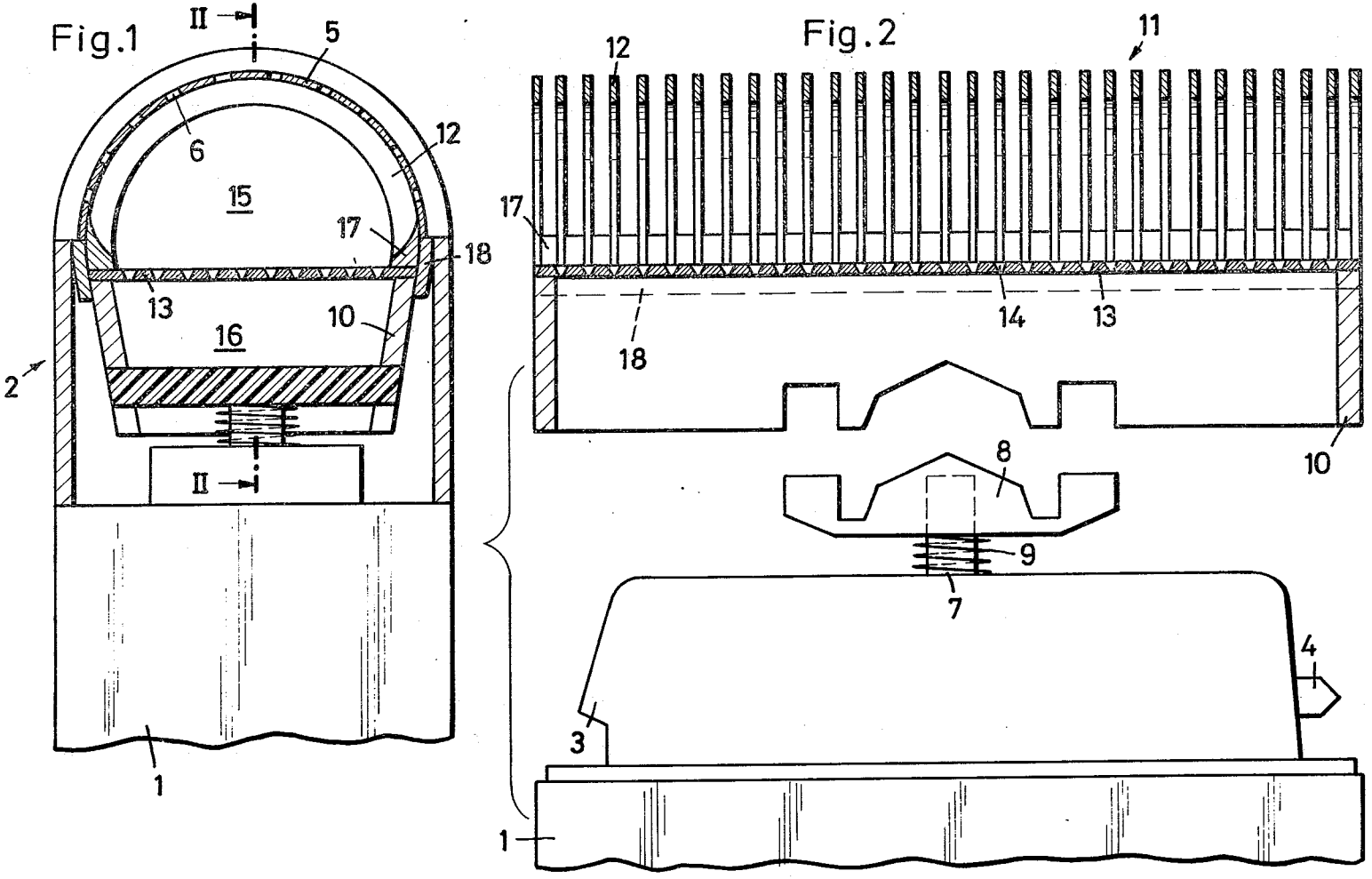

1
2
3
4
5
6
7
8
9
10
11
12
13
14
15
16
17
18
II
II

ELECTRIC SHAVER

This invention relates to electric shavers, and particularly to an improvement in an electric shaver which permits more shaves between cleaning operations without impairing the function of the shaver.

All electric shavers now in practical use have a body and a head releasably secured to the body. One or more blades are moved in a cavity between the head and the body by an electric drive in the body for shearing cooperation with a guard of sheet material on the head. As the head is moved over the area to be shaved, hair enters the cavity through perforations in the guard and is sheared between the guard and the blade or blades. The clippings accumulating in the cavity tend to wedge between the blade edges and the guard so as to force them apart. Even a minute increase in the clearance between blade edges and guard impairs the cutting action, and it is necessary frequently to remove the head of a conventional shaver and to clean it of hair clippings, an operation which is inconvenient at best and timeconsuming with many makes of shavers.

It has now been found that the clippings may be trapped in the shaver cavity in such a manner that they cannot accumulate near the shearing area, whereby intervals between cleaning operations may be greatly extended.

In its more specific aspects, the invention provides an electric shaver whose body member and head member may be releasably secured to each other in a position in which the secured members jointly define a cavity. A partition in the cavity divides the same into two compartments, a first compartment being adjacent a guard of sheet material on the head member and directly communicating with perforations of the guard, and the second compartment being remote from the perforations. The partition is formed with a multiplicity of apertures connecting the compartments. Blades mounted in the first compartment are releasably connected to an electric drive in the body member which moves the blades relative to the engaged guard, whereby hair projecting into the first compartment through the perforations in the partition is sheared, and the resulting clippings pass into the second compartment where they are trapped, particularly when the orifice of each aperture open toward the first compartment is larger than the orifice open toward the second compartment.

Other features, additional objects, and many of the attendant advantages of this invention will readily be appreciated as the same becomes better understood from the following detailed description of a preferred embodiment when considered in connection with the appended drawing in which:

FIG. 1 shows an electric shaver according to the invention in fragmentary side elevation and partly in section; and FIG. 2 is an exploded, front-elevational view of the shaver body and the blade assembly, the assembly being shown in section on the line II — II in FIG. 1.

The illustrated apparatus is a modification of a shaver which has been for sale under the name of "Ronson" for many years. Its plastic body 1 encloses an electrically operated drive mechanism. A hollow metal head 2 is normally clamped to the body 1 between a projection 3 and a detent 4 on the body. An approximately semicylindrical face of the head 2 directed away from the body 1 is formed by a thin metal foil 5 having numerous perforations 6, hereinafter referred to as the guard.

The output pin 7 of the drive mechanism, not otherwise seen in the drawing, projects from the body 1 into the cavity of the head 2 and carries a resilient, plastic coupling element 8 which is biased against a non-illustrated stop on the pin 7 by a helical compression spring 9. The coupling element 8 normally attaches the base 10 of a blade assembly 11 to the pin 7 for rapid reciprocating movement of the blade assembly parallel to the plane of FIG. 2 when the electric drive mechanism is energized.

The base 10 is an elongated, box-like metal structure which is open toward the pin 7 and toward the guard 5. The opening of the base 10 directed toward the guard 5 is bridged by a multiplicity of narrow blades 12 whose cutting edges are approximately circularly arcuate about an axis parallel to the direction of reciprocating assembly movement and conformingly engage the inner face of the guard 5 under the pressure of the spring 9. The structure described so far is conventional.

According to this invention, the blade assembly 11 further includes a thin partition 13 formed with a multiplicity of apertures 14 and mounted between the base 10 and the blades 12 so as to divide the cavity in the head 2 into a first compartment 15 near the guard 5 and directly communicating with its perforations 6, and a second compartment 16 near the body 1. The compartment 15 encloses the blades 12 while the base 10 is received in the compartment 16.

The orifices of the apertures 14 which are open toward the compartment 16 are smaller than the orifices open toward the compartment 15, and each aperture tapers conically between its two orifices. Guides 17 mounted on the partition 13 between adjacent blades 12 lead arcuately from the cutting edges of the blades to the face of the partition in the compartment 15. Two sealing strips 18 are mounted on the outside of the blade assembly 11 approximately on the level of the partition 13 for movably sealing engagement with the head 2.

During the operation of the shaver, hair projecting through the perforations 6 into the compartment 15 is sheared between the guard 5 and the blades 12, and the clippings drop to the partition 13 in the normal operating position of the shaver. They are tossed back and forth by the oscillating assembly 11 until they find their way into apertures 14 and drop into the compartment 16. Their return to the compartment 15 is impeded not only by gravity in the normal position of the shaver, but even in the inverted shaver because of the small orifices of the apertures 14 in the compartment 16. Only an insignificant fraction of the clippings can find its way between the assembly 11 and the body 1, and thereafter between the narrow front and rear faces of the assembly and the head 2 where some clearance is necessary for the reciprocating cutter assembly movement. Once the cuttings are removed from the compartment 15, they can no longer affect the shearing cooperation of the blades 12 with the guard 5, and the shaver can be operated for extended periods with clippings practically filling the compartment 16.

While the invention has been described with particular reference to an electric shaver having a curved guard of thin metal and blades mounted on the shaver body, its basic features are equally applicable to other types of electric shavers, such as those having rotary blades mounted on the shaver head and spinning behind individual guards, and shavers having flat guards and reciprocating blade assemblies.

It should be understood, therefore, that the foregoing disclosure relates only to a preferred embodiment of the invention, and that it is intended to cover all changes and modifications of the example of the invention herein chosen for the purpose of the disclosure which do not depart from the spirit and scope of the invention set forth in the appended claims.

What is claimed is:

1. An electric shaver comprising:

a. body member;

b. a head member including a guard of sheet material formed with perforations therethrough;

c. securing means for releasably securing said members to each other in a position in which the secured members jointly define a cavity;

d. a partition in said cavity dividing the cavity into a first compartment adjacent said guard and directly communicating with said perforations and a second compartment remote from said perforations, said partition being formed with a multiplicity of apertures connecting said compartments;

e. blade means mounted in said first compartment on one of said members and engaging said guard; and f. electrically operated drive means in said body member connected to said blade means and to said partition for moving the blade means and the partition relative to said guard and for thereby shearing hair projecting into said first compartment through said perforations, and for removing the sheared hair from said first compartment to said second compartment.

2. A shaver as set forth in claim 1, wherein each of said apertures has a first orifice open toward said first compartment and a second orifice open toward said second compartment and smaller than said first orifice.

3. A shaver as set forth in claim 2, wherein said apertures taper gradually from said first toward said second orifices respectively.

4. A shaver as set forth in claim 2, wherein said partition is fixedly fastened to said blade means for joint movement by said drive means.

5. A shaver as set forth in claim 4, further comprising sealing means on said partition movably engaging said head member for limiting communication between said compartments.

6. A shaver as set forth in claim 2, wherein said blade means include a plurality of blade members fixedly mounted on said partition and having respective edges engaging said guard, said shaver further including guide means mounted on said partition for guiding sheared hair from said edges to said apertures.

* * * * *